United States Patent [19]

French et al.

[11] Patent Number: 4,854,065

[45] Date of Patent: Aug. 8, 1989

[54] HAMMER BLOCK DEVICE

[75] Inventors: Kendrick L. French, Lebanon, Me.; Mark C. Laney, Lee, N.H.

[73] Assignee: K.W. Thompson Tool Company, Inc., Rochester, N.H.

[21] Appl. No.: 254,953

[22] Filed: Oct. 7, 1988

[51] Int. Cl.[4] ..... F41C 17/00

[52] U.S. Cl. ..... 42/65; 42/69.01

[58] Field of Search ..... 42/65, 69.01, 69.03

[56] References Cited

U.S. PATENT DOCUMENTS

| | | |
|---|---|---|
| 66,072 | 6/1867 | Blake . |
| 600,337 | 3/1898 | Richardson . |
| 609,233 | 8/1898 | Houghton . |
| 811,807 | 2/1906 | Wesson . |
| 835,380 | 11/1906 | Wesson et al. . |
| 855,227 | 5/1907 | Bull . |
| 1,070,145 | 8/1913 | Lewis . |
| 1,297,859 | 3/1919 | Johnson . |
| 1,405,765 | 2/1922 | Diehm . |
| 2,758,404 | 8/1956 | Tabor . |
| 2,832,167 | 4/1958 | Fox . |
| 3,988,848 | 11/1976 | Chatigny . |

FOREIGN PATENT DOCUMENTS

| | | | |
|---|---|---|---|
| 588225 | 5/1925 | France | 42/69 |

*Primary Examiner*—Deborah L. Kyle
*Assistant Examiner*—Richard W. Wendtland
*Attorney, Agent, or Firm*—Blodgett & Blodgett

[57] ABSTRACT

A firearm having a frame, a barrel, a trigger which is pivotally connected to the frame, a hammer which is pivotally connected to the frame, and a hammer block which is integral with the trigger and extends upwardly from the trigger to prevent the hammer from reaching it forward firing position when the trigger is in its forward position, and allowing the hammer to reach its forward firing position when the trigger is in its rearward position. The trigger is biased to its forward position and the hammer is also biased to its forward firing position.

10 Claims, 2 Drawing Sheets

HAMMER BLOCK DEVICE

BACKGROUND OF THE INVENTION

The present invention relates in general to a firearm in which firing is initiated by the strike of a hammer which is controlled by a trigger mechanism. The invention is particularly directed to a firearm in which a hammer block is employed to prevent the hammer from reaching its striking position for firing except under a predetermined set of conditions.

In the typical firearm which utilizes a hammer block, the hammer block remains in a blocking position when the hammer alone is actuated. The hammer block is moved from its blocking position through the action of the trigger mechanism. In other firearms, a transfer plate is used in place of a hammer block. In such a firearm, the hammer is incapable of striking the percussion element in its extreme forward position. The transfer plate is interposed between the percussion element and the hammer by the action of the trigger mechanism. The mechanism for activating the hammer block or transfer plate for each firearm involves a complicated lever and linkage arrangement. The parts which makeup the actuating mechanism for the hammer block or transfer plate require a high degree of precision. The plurality of moving parts which make up the hammer block actuating mechanism add considerably to the cost of the firearm and are subject to wear. This, in turn, affects the long term reliability of the firearm. These and other difficulties experienced with the prior art firearms have been obviated by the present invention.

It is, therefore, a principal object of the invention to provide a firearm having a hammer block which requires no moving parts between the trigger mechanism and the hammer block.

Another object of this invention is the provision of a firearm having a hammer block in which the firearm cannot be fired by pulling the trigger alone.

A further object of the present invention is the provision of a firearm having a hammer block which is also utilized for holding the hammer in a cocked position and for preventing release of the hammer to a firing position except by operation of the trigger mechanism.

It is another object of the present invention to provide a firearm having a hammer block which is actuated, in part, by the hammer and, in part, by the trigger, so that firing of the gun requires operation of both the trigger and hammer in a predetermined sequence.

A still further object of the invention is a provision of a firearm having a hammer block which is simple in construction, inexpensive to manufacture, easy to operate, and which provides a long life of useful service.

With these and other objects in view, as will be apparent to those skilled in the art, the invention resides in the combination of parts set forth in the specification and covered by the claims appended hereto.

SUMMARY OF THE INVENTION

In general, the invention consist of a firearm having a trigger which is pivoted to the frame and biased in the forward position, a hammer which is pivoted to the frame and biased in a forward position and a hammer block which is fixed to the trigger. The hammer block extends from the pivot point of the trigger to a position in which it blocks the hammer from reaching its forward firing position when the trigger is in its forward position. More specifically, the hammer, acting through the hammer block, prevents the trigger from being moved rearwardly from its forward position and causes the trigger to move from its forward position to an intermediate position when the hammer is moved to its rearward cocked position. Thereafter, the trigger can be pulled to its rearward position to release the hammer to its forward firing position.

BRIEF DESCRIPTION OF THE DRAWINGS

The character of the invention, however, may be best understood by reference to one of its structural forms as illustrated by the accompanying drawings, in which.

DESCRIPTION OF THE PREFERRED EMBODIMENT

Figure 1:
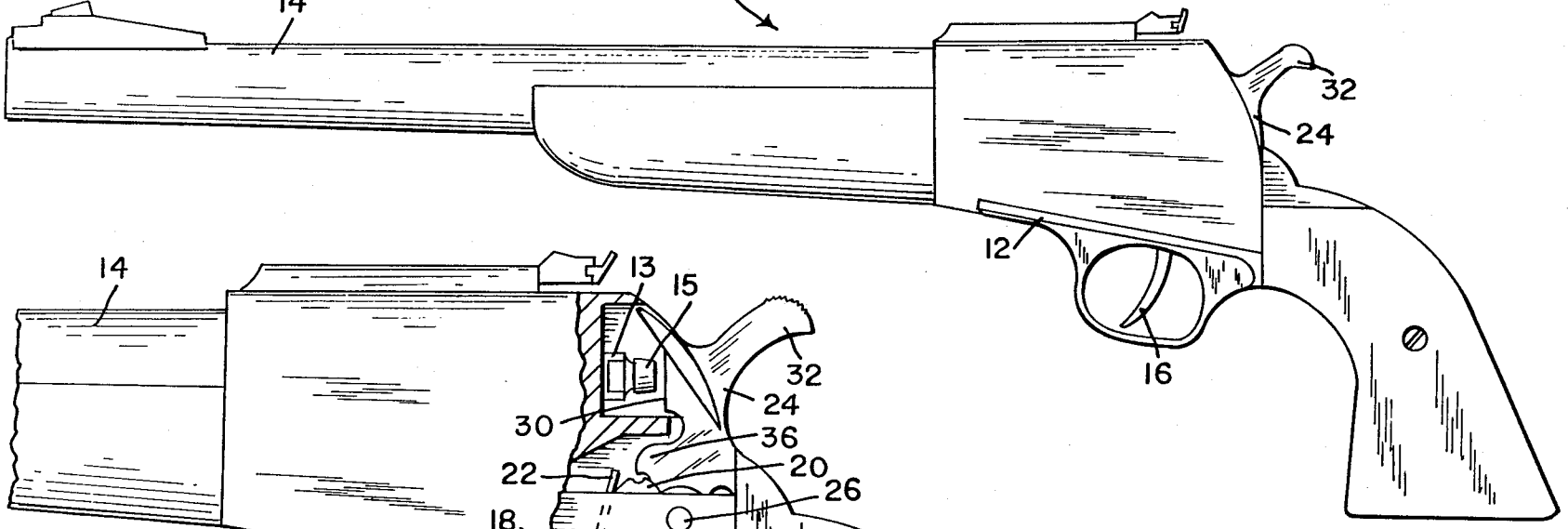
FIG. 1 is a front elevational view of a firearm embodying the principles of the present invention.
Figure 2:
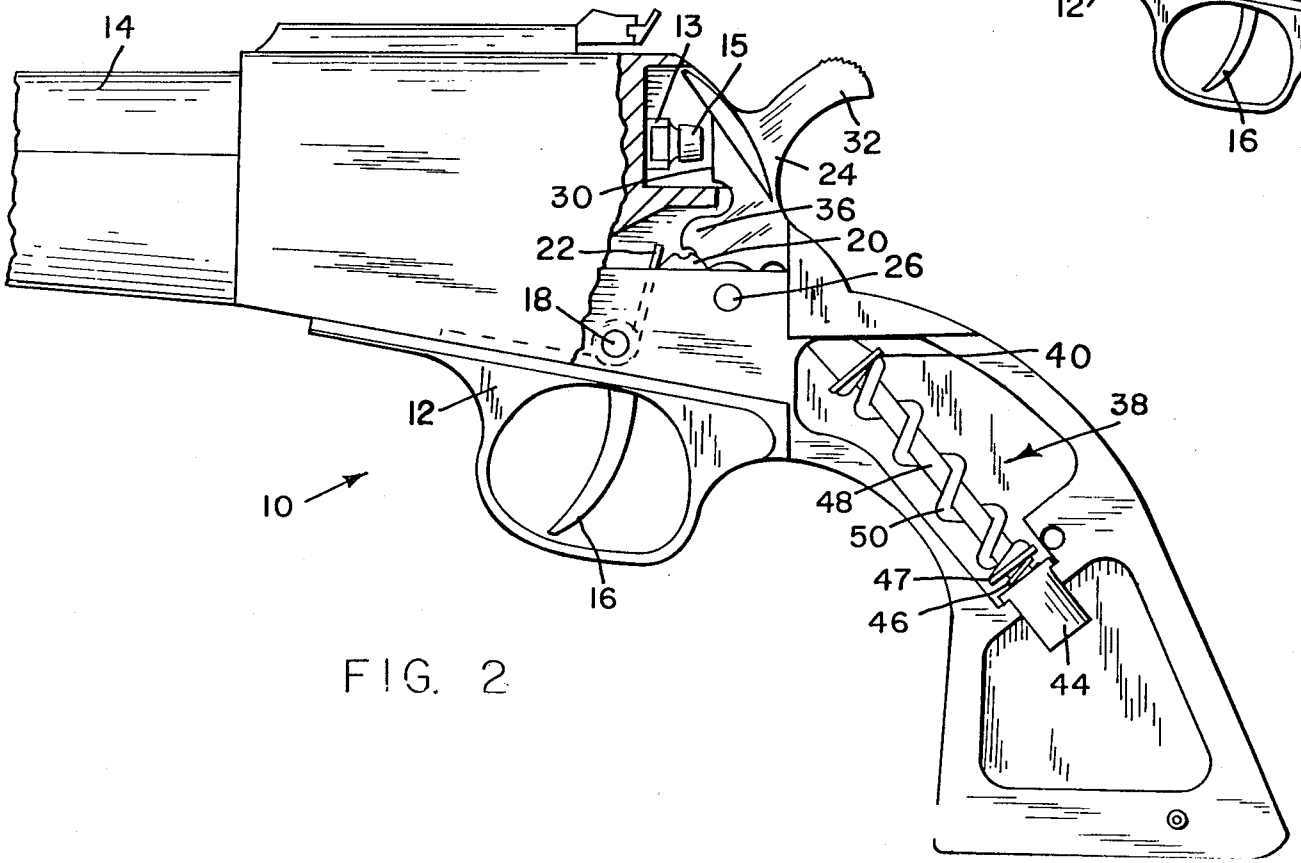
FIG. 2 is a fragmentary side elevational view of the firearm on an enlarged scale with portions broken away.

Referring first to FIGS. 1 and 2 there is shown a firearm embodying the principles of the present invention and generally indicated by the reference numeral 10. The firearm 10 is by way of example a black powder pistol having a frame 12, a barrel 14, a nipple 13 which contains a percussion cap 15 which is mounted behind the firing chamber of the firearm. The trigger 16 is pivotally connected to the frame 12 by means of a pivot pin 18 and biased to the forward position shown in FIG. 2 by a spring 22. A hammer 24 is pivotally connected to the frame 12 by means of a pivot pin 26.

Figure 3:
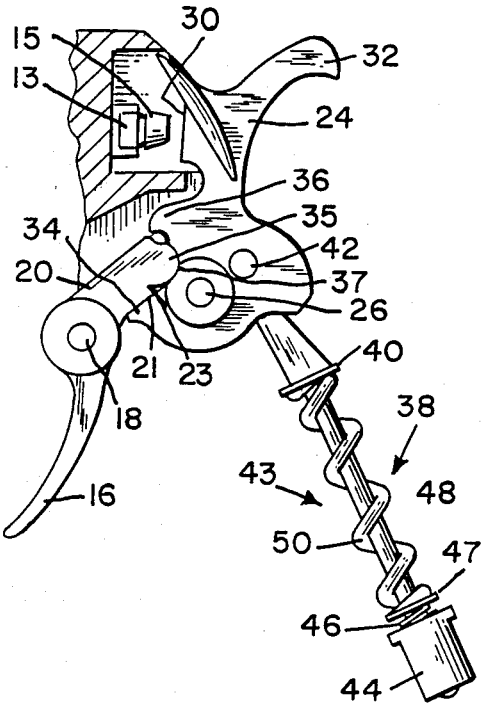
FIG. 3 is a diagrammatic view of the trigger and hammer mechanisms in the normal non-operational condition.

Referring to FIGS. 1–5 a hammer block 20 is integral with the trigger 16 and extends upwardly from the pivot 18. The hammer block 20 normally occupies a rearward position when the trigger 16 is in its forward position as shown in FIG. 3. The hammer block 20 has a rearwardly facing surface 21 which has a rearwardly facing notch 23 for a purpose to be described. The upper end of the hammer block has a rounded surface 37, also for a purpose to be described. The hammer 24 has a forwardly facing striking surface 30 which is in line with the percussion cap 15 and a thumb grip 32 for moving the hammer 24 about the pivot pin 26 from the intermediate position shown in FIG. 3, to the rearward cocked position shown in FIG. 4. When the hammer 24 is in its intermediate position, as shown in FIG. 3, it is spaced from the percussion cap 15. An actuator finger 34 is integral with the hammer 24 and extends below the pivot pin 26 in contact with the rearwardly facing surface 21 of the hammer block 20. A retaining finger 36 is also integral with the hammer block 24 and extends forwardly above the hammer block 20 when the hammer block is in its rearward position as shown in FIG. 3. The forward end of the retaining finger 36 has a rounded surface 39 for a purpose to be described. The hammer 24 is biased forwardly against the hammer block 20 by biasing means, generally indicated by the reference numeral 38. The retaining finger 36 traps the hammer block 20 in its rearward position as shown in FIG. 3, and thereby prevents the trigger 16 from being pulled rearwardly. Therefore, the firearm cannot be fired by pulling the trigger alone. The outer end of the hammer block 20 has a lip 35 which strikes the underside of the retaining finger 36 when the trigger 16 is pulled rearwardly a slight amount, thereby preventing any further rearward movement of the trigger.

Figure 4:
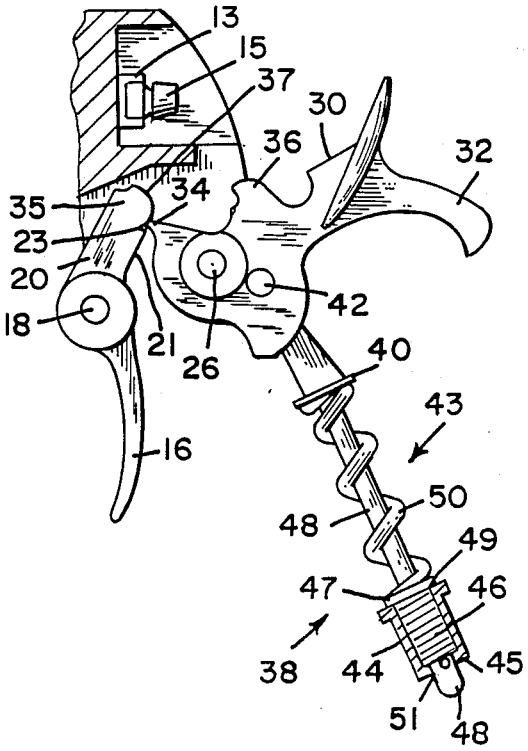
FIG. 4 is a view which is similar to FIG. 3, showing the trigger and hammer mechanisms in their cocked ready to fire positions.
Figure 5:
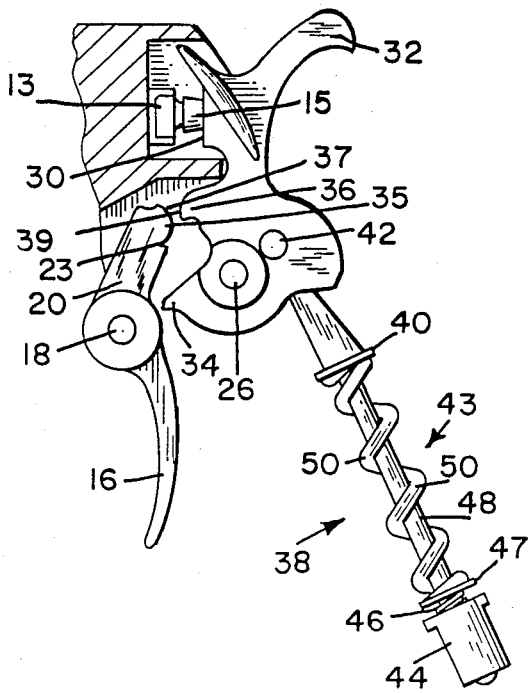
FIG. 5 is a view which is similar to FIGS. 3 and 4, showing the trigger and hammer in their firing positions.

The biasing means 38 which biases the hammer 24 forwardly comprises a mounting block 44 which is fixed to the frame 12 and a spring assembly generally indicated by the reference numeral 43. The spring assembly 43 comprises a first bracket 40 which is pivotally connected to the hammer 24 by means of a pivot pin 42, a second bracket 47, a relatively strong helical compression spring 50 which extends between the brackets 40 and 47, and a relatively weak helical spring 46 which is located on the opposite side of the bracket 47 from the spring 50. The spring 46 is located within the mounting block 44. The outer end of the spring 46 rest against the bottom wall 45 of the mounting block 44. The upper end of the spring 46 extends beyond the upper opening 49 of the mounting block, as shown in FIGS. 3 and 5. A rod 48 is fixed to the bracket 40 and extends downwardly along the helical axes of the springs 50 and 46. When the hammer 24 is in the intermediate position shown in FIG. 3, it is under the biasing influence of the relatively rearwardly, the spring 46 is compressed until the bracket 47 engages the top of the mounting block 44. This prevents any further downward movement of the bracket 47. Additional rearward movement of the hammer 24 causes the bracket 40 to move towards the bracket 47, thereby, compressing the relatively strong spring 50. The hammer 24 is, thereby, under the influence of the biasing pressure of the spring 50 from a short distance rearwardly of the intermediate position shown in FIG. 3, to the fully cocked position shown in FIG. 4. Rearward movement of the hammer 24 from the intermediate position shown in FIG. 3 causes the actuator finger 34 to engage the rearwardly facing surface 21 of the hammer block 20, and cause the hammer block 20 to swing forwardly and the trigger 16 to swing rearwardly. When the hammer 24 reaches its rearward cocked position, as shown in FIG. 4, the actuator finger 34 engages the notch 23. This maintains the hammer 24 in the rearward or cocked position. The trigger 16 is in an intermediate position and is prevented from moving forwardly by the actuator finger 34. The firearm 10 is, thereby, cocked and ready to fire. Firearm 10 is fired by moving the trigger 16 from its intermediate position shown in FIG. 4 to its rearward position shown in FIG. 5. This action causes the hammer block 35 to move forwardly so that the notch 23 pulls away from the actuator finger 34, thereby releasing the hammer 24 for forward motion by the biasing means 38. When the trigger 16 is pulled back to its rearward position, the hammer block 20 is sufficiently forward so that it is clear of the hammer when the hammer moves to its forward firing position as shown in FIG. 5. The percussion cap 15 is struck by the forward striking surface 30 of the hammer, thereby, causing the firearm to discharge. When the trigger 16 is released after firing of the firearm 10, the rounded outer surface 37 of the hammer block engages the rounded outer surface 39 of the retaining finger 36. The relatively weak spring 46 is substantially weaker than the spring 22. Since the hammer 24 is under the biasing influence of the relatively weak spring 46, the hammer block 20 which is under the influence of the stronger spring 22 pushes the hammer 24 rearwardly. The rounded surface 37 is rearward of the pivot pin 18 so that rearward movement of the hammer block 20 causes the surface 37 to move downwardly. The rounded surface 39 is forward of the pivot pin 26 so that rearward movement of the retaining finger 36 causes the surface 39 to move upwardly. As the hammer block 20 and the hammer 24 move rearwardly, the surfaces 37 and 39 slide along each other until the lip 35 drops below the retaining finger 36 as shown in FIG. 3. The firearm 10 is now in condition for reloading and subsequent firing.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus describe, what is claimed as new and desired to secure by Letters Patent is:

1. A firearm:

(a) which has a frame and a barrel, (b) a trigger which is pivotally connected to the frame for pivoting movement relative to the frame about a first pivot point between a forward position and a rearward position, (c) first biasing means for biasing said trigger toward said forward position, (d) a hammer block which is fixed to the trigger and which extends from said first pivot point in the opposite direction from said trigger so that when the trigger is in said forward position, the hammer block is in a rearward position and when the trigger is in its rearward position, the hammer block is in a forward position, (e) a hammer which is pivotally connected to the frame at a second pivot point which is rearward of said trigger for pivoting movement relative to the frame between a forward firing position and a rearward cocked position, said hammer engaging said hammer block when said hammer block is in its rearward position and said trigger is in its forward position and said hammer is in an intermediate position between said forward firing position and said rearward cocked position to prevent said hammer from reaching said forward firing position, (f) second biasing means for biasing said hammer toward its forward position, (g) an actuator which is fixed to said hammer and which extends from said second pivot point in the opposite direction from said hammer for engaging said hammer block and moving said hammer block forwardly and said trigger rearwardly to an intermediate position between the forward and rearward positions of said trigger and said hammer block when said hammer is moved to its rearward position, and (h) latching means associated with said hammer block and said actuator for locking said hammer in its rearward position against forward motion and said trigger in its intermediate position against forward motion, said latching means being rendered ineffective to lock, said hammer in its rearward position upon movement of said trigger to its rearward position so that said hammer is moved to its forward firing position by said second biasing means.

2. A firearm as recited in claim 1, wherein said latching means comprises:

(a) a notch in one of said hammer block and said actuator, and (b) a projection in the other of said hammer block and said actuator for engaging said notch when said trigger is in its intermediate position and said hammer is in its rearward position, said finger being clear of said notch when said trigger is moved from it intermediate position.

3. A firearm as recited in claim 1, wherein said hammer comprises a retaining finger for preventing said hammer block from moving forwardly and said trigger from moving rearwardly when said hammer block is in its rearward position, said retaining finger being moved out of engagement with said hammer block when said hammer block is moved forwardly by said actuator to permit rearward movement of said trigger.

4. A firearm as recited in claim 1, wherein said second biasing means comprises:

(a) a relatively weak spring for biasing said hammer between the intermediate position and the forward position of said hammer, and (b) a relative strong spring for biasing said hammer between the intermediate position and the rearward position of said hammer.

5. A firearm as recited in claim 1, wherein said second biasing means comprises:

(a) a mounting block which is fixed to the frame and spaced from said hammer, said mounting block having an opposing surface which faces said hammer, (b) a spring assembly which is located between said hammer and said mounting block, said first spring assembly comprising:

(1) a first bracket which is operatively connected to said hammer, (2) a second bracket which is located between said first bracket and said mounting bracket and normally spaced from said mounting bracket, and (3) first relatively strong helical compressing spring which extends from said first bracket to said second bracket so that said spring is compressed when one of said brackets is moved toward the other of said brackets, said helical compression spring having a central longitudinal axis which extends through said mounting block and said spring assembly being movable along said axis toward and away from said mounting block, and (4) a second relatively weak compression spring for biasing said spring assembly away from said mounting block and for biasing said hammer from its intermediate position to its forward position, wherein rearward movement of said hammer compresses said second spring and causes said spring assembly to move toward said mounting block until said second bracket engages said second bracket engages said opposing surface so that additional rearward movement of said hammer causes said first bracket to move toward said second bracket and compressing said second spring, whereby said hammer i biased toward its intermediate position by said second spring.

6. A firearm comprising:

(a) a housing which has a frame and a barrel, (b) a hammer which is mounted on the frame for pivoting movement about a first pivot point relative to the frame between a forward firing position and a rearward position (c) first biasing means for biasing said hammer toward said forward position, (d) a trigger assembly which is mounted on the frame for pivoting movement about a second pivot point relative to the frame, said second pivot point being spaced from said first point, said trigger assembly comprising:

(1) a trigger which extends downwardly from said second pivot point for movement about said second pivot point between a forward position and a rearward position, and (2) a hammer block which is integral with said trigger and which extends upwardly from said second pivot point so that when said trigger is in its forward position said hammer block is in a rearward position and when said trigger is in its rearward position, said hammer block is in a forward position, said hammer block preventing said hammer from reaching its forward firing position when said hammer block is in its rearward position, said hammer block allowing said hammer to reach its forward firing position when said hammer block is in its forward position and said trigger is in its rearward position, and (e) second biasing means for biasing said trigger toward its forward position and said hammer block toward its rearward position.

7. A firearm as recited in claim 6, wherein said hammer block has a rearwardly facing notch and said firearm has an actuator finger which is fixed to said hammer and which extends from said first pivot point in the opposite direction from said hammer for engaging said hammer block and moving said hammer block forwardly ad said trigger rearwardly to an intermediate position between the forward and rearward positions of said trigger when said hammer reaches its rearward position, wherein said actuator finger engages said notch to prevent forward movement of said trigger and said hammer and to maintain said hammer in its rearward and cocked position, and wherein movement of said trigger from its intermediate position to its rearward position disengages said notch from said actuator finger and releases said hammer for forward movement by said first biasing means to its forward firing position.

8. A firearm as recited in claim 7, wherein said hammer comprises a retaining finger which occupies a retaining position when said hammer is in its intermediate position for preventing said hammer block from moving forwardly and said trigger from moving rearwardly when said hammer block is in its rearward position, said retaining finger being moved out of said retaining position when said hammer block is moved forwardly by said actuator to permit rearward movement of said trigger.

9. A firearm as recited in claim 6, wherein said hammer comprises a retaining finger which occupies a retaining position when said hammer is in its intermediate position for preventing sad hammer block from moving forwardly and said trigger from moving rearwardly when said hammer block is in its rearward position, said retaining finger being moved out of said retaining position when said hammer block is moved forwardly by said actuator to permit rearward movement of said trigger.

10. A firearm as recited in claim 9, wherein said second biasing means comprises a first relatively weak spring which is weaker than said first biasing means for biasing said hammer forwardly between the intermediate position of said hammer and the forward position of said hammer and a second relatively strong spring which is substantially stronger than said relatively weak spring for biasing said hammer forwardly between the intermediate position of said hammer and the rearward position of said hammer, and, wherein the outer end of said hammer block has a rearwardly facing first rounded surface and said retaining finger has a forwardly facing second rounded surface which is engaged by said first rounded surface when said hammer is at its forward firing position and said trigger is released from its rearward position after firing, said first biasing means causing said hammer block to push said hammer rearwardly against the biasing effect of said first relatively weak spring, said first rounded surface being rearward of and above said first pivot point and said second rounded surface being forward of and above said second pivot point so that as the hammer block moves rearwardly, said first rounded surface moves downwardly and as said hammer moves rearwardly, said second rounder surface moves upwardly along said first rounded surface so that when said hammer block reaches its rearward position, said retaining finger is above said hammer block and in position for retaining said hammer block against forward motion, and said trigger against rearward motion.

* * * * *